United States Patent [19]

Hamlin

[11] 4,269,406

[45] May 26, 1981

[54] DOCUMENT HANDLER

[75] Inventor: Thomas J. Hamlin, Macedon, N.Y.

[73] Assignee: Xerox Corporation, Stamford, Conn.

[21] Appl. No.: 81,499

[22] Filed: Oct. 3, 1979

[51] Int. Cl.[3] ..... B65H 3/12; B65H 3/18

[52] U.S. Cl. ..... 271/108; 271/3.1; 271/35; 271/98

[58] Field of Search ..... 271/3.1, 5, 11, 20, 271/90, 94, 96, 98, 99, 104–106, 108, 35, 161, 165–167, 276, 112, 132, 133

[56] References Cited

U.S. PATENT DOCUMENTS

| | | | |
|---|---|---|---|
| 1,418,145 | 5/1922 | Fischer | 271/108 X |
| 1,888,194 | 11/1932 | Broadmeyer | 271/98 |
| 2,764,407 | 9/1956 | Alix | 271/108 |
| 3,837,638 | 9/1974 | Anderson et al. | 271/98 X |

*Primary Examiner*—Robert W. Saifer

[57] ABSTRACT

An automatic document handler employing a bottom vacuum sheet separator in conjunction with an air knife, a single blower with a cyclically operated air valve being utilized to provide sub-atmospheric air for the separator and pressurized air for the air knife to provide enhanced feeder performance and automatically compensate for variable paper weights.

3 Claims, 4 Drawing Figures

DOCUMENT HANDLER

BACKGROUND OF THE INVENTION

With the advent of high speed xerographic copy reproduction machines wherein copies can be produced at a rate in excess of three thousand copies per hour, the need for a document handler to feed documents to the copy platen of the machine in a rapid, dependable matter was recognized to enable full utilization of the reproduction machines potential copy output. A number of document handlers are currently available to fill that need. These document handlers must operate flawlessly to virtually eliminate the risk of damaging the originals and generate minimum machine shutdowns due to uncorrectable misfeeds or documents multifeeds. It is in the initial separation of the individual documents from the document stack where the greatest number of problems occur.

Since the documents must be handled gently but positively to assure separation without damage through a number of cycles, a number of separators have been suggested such as friction rolls or belts used for fairly positive document feeding in conjuction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member, if it acts upon the printed face can cause smearing or partial erasure of the printed material on the document. With single sided documents, this does not present a problem as the separator can be designed so that the retard mechanism acts upon the underside of the document. However, with documents printed on both sides, there is no way to avoid the problem. Additionally, the reliable operation of friction retard feeders is highly dependent on the relative frictional properties of the paper being handled. This cannot be controlled in a document feeder.

In document hanlers where the document set may be circulated a plurality of times, the document handler is normally provided with a bottom sheet separator-feeder to allow feeding of documents while documents which have already been copied to be returned to the top of the document stack. In this way after all the documents have been copied, they are in the correct order for recirculation if necessary.

One of the major problems with bottom sheet feeders is that without knowing how large a stack of documents is to be placed in the feed tray or the paper weight of the individual documents, it is difficult to design a sheet separator that is gentle enough for small stacks of light weight paper and still be capable of handling large stacks of heavy weight paper.

It is therefore the object of this invention to provide a document handler that automatically compensates for variable weight sheets without complicated controls or mechanisms.

SUMMARY OF THE INVENTION

A document feeder for separating and feeding the bottom sheet in a sheet stack including a plurality of vacuum feed belts spaced below the surface of the sheet stack tray, positive air pressure means being provided for air floatation of the stack to reduce the weight of the stack on the bottom sheet thereof. A single blower is utilized to provide the sub-atmospheric pressure for the vacuum feed means and the air supply for air floatation to provide optimized air flow in the feeder-separator. To control the flow of air to the stack, valve means in the blower inlet line are provided to control the flow of air during feeding and document restacking.

DESCRIPTION OF THE PREFERRED EMBODIMENT

Figure 1:
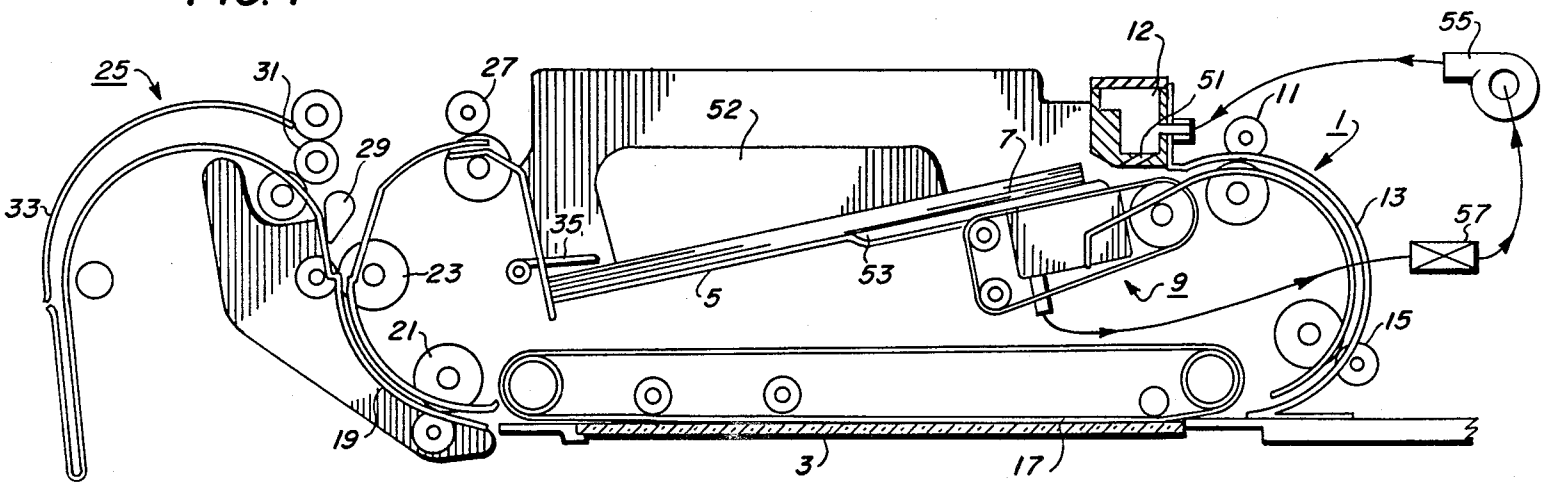
FIG. 1 is a cross-sectional view of an exemplary document handler employing the sheet separator-feeder of the present invention.

Referring to the drawings, there is illustrated an automatic document handler 1 for installation above the exposure platen 3 of a xerographic reproduction machine. The document handler is provided with a document tray 5 to be explained more fully hereinafter, adapted for supporting a stack of documents 7 face up. A vacuum belt-corrugating feeder mechanism 9 is located below the document tray for acquiring and corrugating the bottom document in the stack and forwarding the document to take away roll pair 11 after an air knife 12 has had time to separate sheet 1 from the rest of the stack. The document is then fed by take-away roll pair 11 through document guide 13 to feed-roll pair 15 and under platen belt 17 onto the platen of the copy machine for reproduction. After exposure of the document, it is fed off the platen by belt 17 into guide 19 and feed-roll pairs 21 and 23 either to an inverter mechanism 25 or back to the document stack through the feed-roll pair 27. A divertor 29 is provided to divert the document either to the inverter or to the feed roll pair 27. The inverter comprises a three roll arrangement 31 and a closed inverter pocket 33. If the document is to be inverted it is fed through the lower two rolls of the three roll inverter into the pocket. When the trail edge of the document clears the nip of the lower two rolls in the three roll inverter, the stiffness of the sheet will cause the trail edge to straighten up into the nip of the upper two rolls of the inverter at which time it will be fed into roll pair 27 and back into the document stack. The inverter pocket illustrated is sized such that when the leading edge of the document contacts the end of the pocket, the document will buckle slightly within the upper portion of the pocket 33, the buckle thereby providing the required force to feed the trailing edge of the document into the upper roll pair of the inverter rolls for feeding the sheet toward roll pair 27. If desired, an open ended inverter pocket could be utilized having a feed roll pair associated therewith for feeding the document back into the upper roll pair in a positive manner rather than relying on the sheet buckle to feed the document thereto.

The document handler is also provided with a sheet separator finger 35 as is well known in the art to separate the documents to be fed from those documents returned to the document handler. Upon removal of the last document from beneath sheet separator finger 35, the finger 35 drops through a slot provided in the tray, suitable sensors are provided to sense that the last document in the set has been removed from the tray and the finger is then rotated in a clockwise direction to again come to rest on the top of the documents in the stack prior to subsequent recirculation of the document set.

Figure 2:
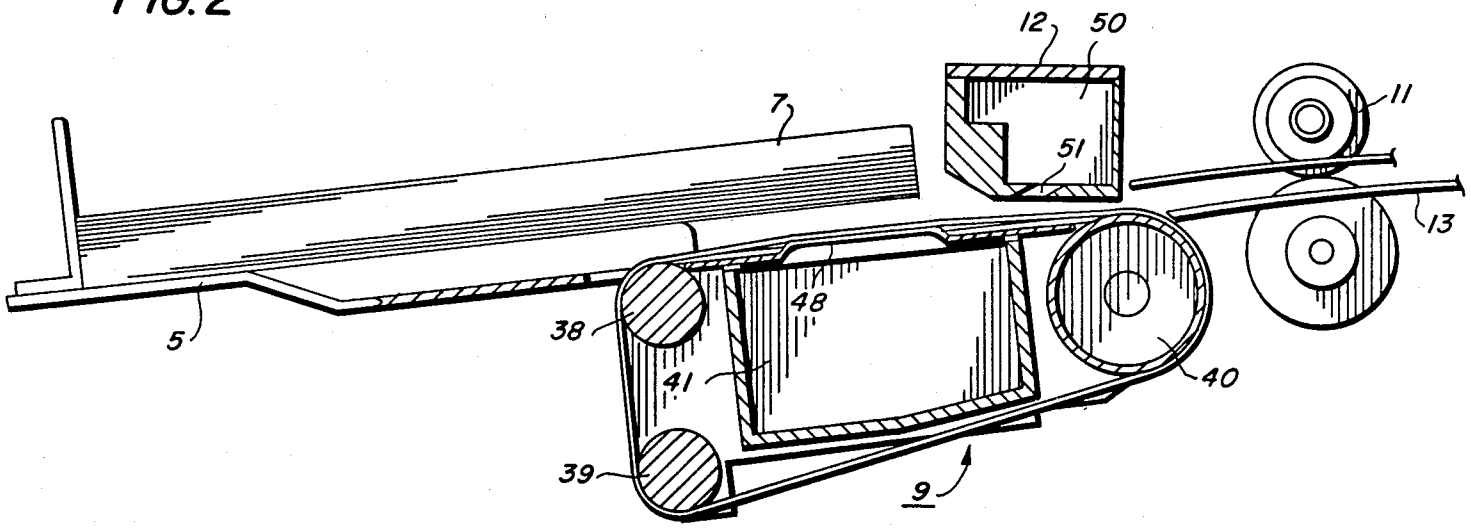
FIG. 2 is an enlarged, cross-sectional view of the separator-feeder portion of the document handler of FIG. 1.
Figure 3:
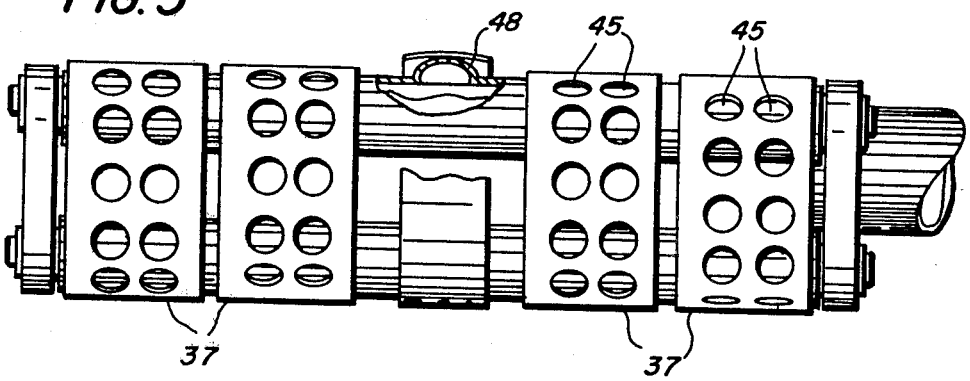
FIG. 3 is an end view, partially in section of the vacuum feed belts illustrated in FIG. 2.
Figure 4:
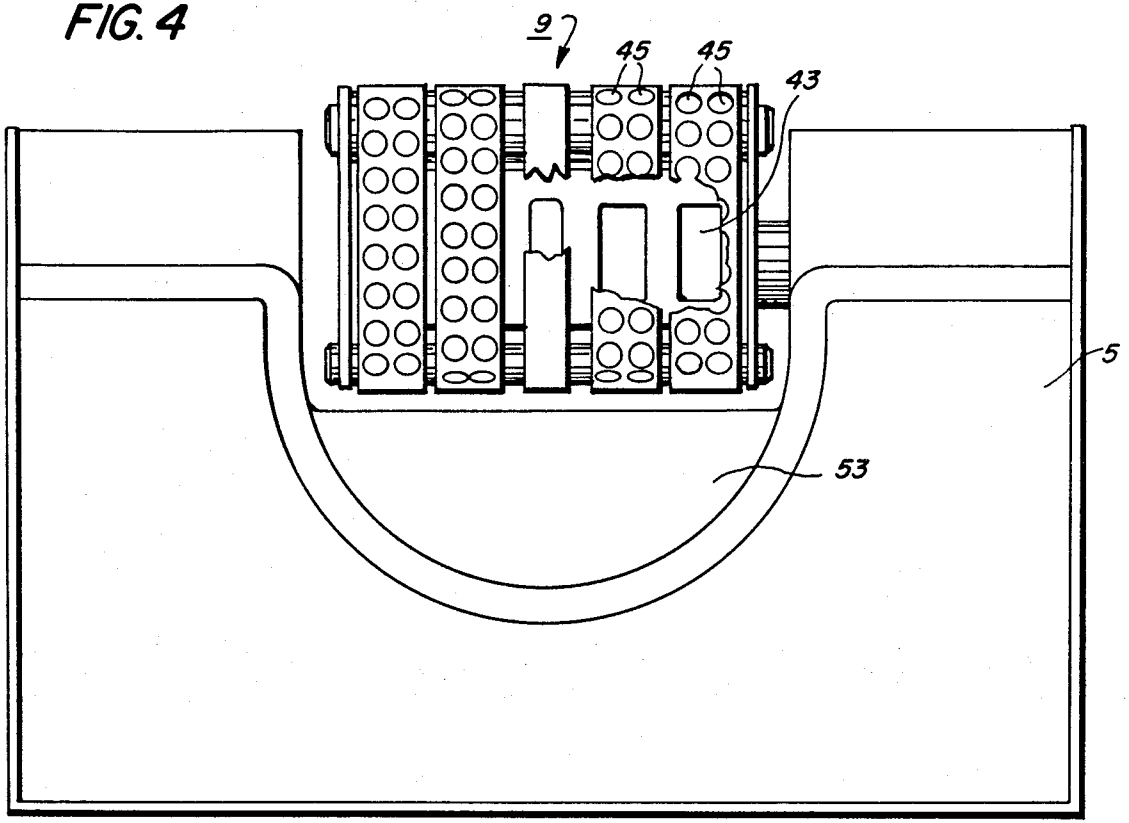
FIG. 4 is a top view of the document tray and feed belts of the document handler illustrated in FIG. 1.

Referring more paticularly to FIGS. 2, 3 and 4 wherein the novel document separator-feeder is more clearly illustrated, there is disclosed a plurality of feed belts 37 supported for movement on feed belt rolls 38, 39, and 40. Spaced within the run of the belts 37 there is provided a vacuum plenum 41 having openings 43 therein adapted for cooperation with perforations 45 in the belts 37 to provide a vacuum for pulling the bottom document in the document stack onto the belts 37. As can be seen from FIG. 3, the plenum is provided with a raised portion 48 beneath the center belt run so that upon capture of the bottom document in the stack against belts 37, a center corrugation will be produced in the bottom sheet. Note also that the belts are below the surrounding support surfaces. Thus the document is corrugated into a double valley configuration. The flat surfaces of the vacuum belts on each side of the raised center belt generates a region of maximum stress in the document which varies with the document beam strength. In the unlikely event that more than one document is pulled down into contact with the feed belts, the beam strength of the second document resists the corrugating action, thus gaps are opened between sheets one and two which extend to their lead edges. These gaps and channels reduce the vacuum levels between sheets one and two due to porosity in sheet one and provide for entry of the separating air flow from the air knife 12. The air knife 12 comprised of pressurized air plenum 50 having a plurality of air jet openings 51 is provided to inject air into the pocket formed between the document pulled down against the feed belt and the documents thereabove to provide an air cushion or bearing between the stack and the bottom document to minimize the force necessary for removing the bottom document from the stack. It can be understood that if two documents are pulled down toward the belts 37, since the top sheet would not be corrugated, the air knife would inject air into the space between the two documents and force the second document off from the raised belt back toward the document stack.

By suitable valving and controls, it is desirable to provide a delay between the time the vacuum is applied to pull the document onto the belts and the start up of the feed belts to assure that the bottom document is captured on the belt before belt movement commences and to allow time for the air knife to separate sheet 1 from any sheets that were pulled down with it.

By reference to FIGS. 1, 2 and 4 it can be seen that the document tray 5 is provided with a depressed portion or pocket 53 behind the feed belt assembly. This pocket serves a number of purposes. First, space is provided for the forward portion of the bottom document to be pulled down onto the feed belt assembly providing for formation of the two valley corrugation previously mentioned. When the bottom document is pulled into this space and corrugated, an envelope type opening or pocket is created between the bottom sheet and the remainder of the sheets in the stack. Air injected into this space from the air knife produces an air bearing between the bottom sheet and the remainder of the stack to allow easy removal of the bottom sheet from beneath the stack. Flow of air from the pocket is restricted by the partial seal or flow restriction caused by supporting the major portion of the stack weight on the edge portions of the tray surrounding the pocket.

To further increase the efficiency of the system, the stack tray is provided with a rearward tilt as seen in FIGS. 1 and 2. When floatation air is provided under the stack or between the first and second sheets, gravity will allow the sheets to settle or float back against the rear tray wall. Thus, the sheet being removed is pulled uphill while gravity helps hold the remainder of the sheets back, helping to prevent multifeeds.

By reference to FIG. 1, it can be seen that a single blow unit 55 is utilized to provide subatmospheric pressure in plenum 41 and pressurized air to air knife 12.

A valve 57 is provided in the inlet line to blower 55. With the disclosed system, the blower is operated continuously and air flow through the system is controlled by opening and closing valve 57. At the start of the feed cycle, the valve is opened. Upon opening of the valve, the flow of air from the air knife is greater than the steady state air flow i.e., the pressure and initial air flow "spikes". This initial high flow of air provides the required lifting force to float the sheet stack, which settles onto the tray between feed cycles. Once the stack is lifted by this air "spike", the lower steady state flow of air from the knife is sufficient to maintain the stack in the raised or "floating" position.

At approximately the same time that the air pressure at the air knife "spikes", the bottom sheet is acquired on the vacuum feed belts, thereby maximizing blower inlet vacuum and subsequent reduction of air flow to the air knife to the steady state level. After the bottom sheet has been fed, the valve is again closed to allow return of the previously exposed sheet to the tray without interference from the knife air flow.

With the document handler illustrated, the single blower unit provides air system which is self compensating for sheet thickness of the documents placed in the document tray. When light weight sheets, which have very low beam strength, are placed in the tray, capture of the bottom sheet on the feed belts causes the sheet to closely conform to the tray pocket and lower air flow to the blower which results in a substantial reduction in the air discharged from the air knife. The air flow is not completely stopped since some air will blow through those vacuum holes not completely covered by the sheet since due to the corrugating feature, the sheet will not perfectly conform to the tray shape. Reduced air flow to the air knife results in improved performance with light weight papers since excessive air would lift light weight stacks and could cause sheet blowaway from the sheet stack.

At the other extreme, heavy weight papers ordinarily have a very high beam strength. This beam strength prevents the bottom sheet in the stack from conforming to the tray shape and the feed belts, to a lesser degree than light weight papers. The raised belt portion of the feed belts also contributes to less than complete conformation of the stiff sheets to the feed belt assembly. As such, more of the vacuum port area remains uncovered, thereby allowing a greater air flow to the blower. This provides the greater air flow from the air knife necessary to produce the desired air bearing between the sheet being fed and the remainder of the stack.

Following the feed cycle which in the disclosed embodiment requires approximately 400 milliseconds to remove the bottom sheet from the stack, the air valve 57 is closed. This shuts off air flow to the air knife, allowing the sheet stack to settle back down on the tray and allowing documents to be returned to the tray for restacking without encountering opposing air flow from the air knife. In the disclosed embodiment, the off cycle is approximately 450 milliseconds. It should be understood however, that the off and on cycle times would be dependent on the rate at which it is desired to feed documents. Obviously, with the disclosed embodiment a sheet is fed approximately every 850 milliseconds.

Another important advantage of the disclosed system is that the stack is cyclically raised and lowered. While the major sheet separation is between the bottom sheet in the stack and the second sheet in the stack, there is some separation caused by the air knife between the remainder of the sheets in the stack. This constant separation and resettling of the sheets is particularly advantageous in a document handler. Some of the documents in the feeder may have damaged lead edges, some may have an up curl while others may have a down curl. This is particularly true where the document feeder is provided with an inverter as disclosed heretofor. These conditions may cause a tendency for some sheets to stick together under ordinary circumstances. However, with the disclosed arrangement, the sheets are cyclically raised and lowered which "work" the sheets and minimizes the possibility of adjacent sheets "sticking" together and the resultant multifeeds that could be caused thereby.

From the foregoing it can be seen that utilizing a single blower unit with a cyclically actuated valve to provide the vacuum for the feed belt assembly and the pressurized air for the air knife results in enhanced feeder performance and provides an automatically compensated air system without the need for complicated variable pressure valves or system adjustments for variable paper weights.

While I have described a preferred embodiment of my invention, it should be understood that the invention is not limited thereto but may be otherwise embodied within the scope of the following claims.

What is claimed is:

1. A bottom sheet separator-feeder for separating and forwarding sheets seriatim comprising;

a stack tray adapted for supporting a stack of sheets, vacuum sheet feed means associated with said tray located in a position spaced from the bottom sheet in the stack, air injection means adapted to provide a layer of air between said tray and the bottom sheet in the stack and between the bottom sheet and the remainder of the sheets in the stack, single blower means associated with said vacuum feed means and said air injection means, the inlet to said blower means being connected to said vacuum feed means and the outlet from said blower means being connected to said air injection means; and, valve means associated with the inlet to said blower means, opening of said valve means at the beginning of a sheet feed cycle causing a "spike" in the pressure of the air supplied to said air injection means for initial lifting of the sheet stack from said tray, acquisition of the bottom sheet in the stack by said vacuum feed means resulting in reduced air flow to said air injection means sufficient to maintain the floating position of the stack initiated by the pressure "spike".

2. A bottom sheet separator-feeder according to claim 1 wherein said vacuum feed means comprises a plurality of vacuum feed belts having a vacuum plenum disposed within the run of the belts, said belts being such that the upper surfaces of said belts lie below the top surface of said stack tray.

3. A bottom sheet separator-feeder according to claim 2 wherein the top surface of said plenum has a raised portion thereon such that a corrugation is formed in the sheet acquired by said vacuum feed belts.

* * * * *